US010538982B2

(12) United States Patent
Purkis et al.

(10) Patent No.: US 10,538,982 B2
(45) Date of Patent: Jan. 21, 2020

(54) VALVE ASSEMBLY WITH A FILTER CHAMBER

(71) Applicant: Weatherford U.K. Limited, Leicestershire (GB)

(72) Inventors: Daniel George Purkis, Loughborough (GB); William Murray, Aberdeen (GB)

(73) Assignee: Weatherford U.K. Limited (GB)

( * ) Notice: Subject to any disclaimer, the term of this patent is extended or adjusted under 35 U.S.C. 154(b) by 174 days.

(21) Appl. No.: 15/550,516

(22) PCT Filed: Feb. 11, 2016

(86) PCT No.: PCT/GB2016/050326

§ 371 (c)(1),
(2) Date: Aug. 11, 2017

(87) PCT Pub. No.: WO2016/128753

PCT Pub. Date: Aug. 18, 2016

(65) Prior Publication Data

US 2018/0038181 A1 Feb. 8, 2018

(30) Foreign Application Priority Data

Feb. 11, 2015 (GB) ..... 1502271.8

(51) Int. Cl.
*E21B 34/10* (2006.01)
*E21B 43/38* (2006.01)
(Continued)

(52) U.S. Cl.
CPC ..... *E21B 27/005* (2013.01); *E21B 34/10* (2013.01); *E21B 43/16* (2013.01)

(58) Field of Classification Search
CPC ..... E21B 34/06; E21B 34/10; E21B 43/08; E21B 43/12; E21B 41/0057; E21B 43/34;
(Continued)

(56) References Cited

U.S. PATENT DOCUMENTS 2,802,481 A 8/1957 Jahn
3,863,674 A 2/1975 Scaglione
(Continued)

FOREIGN PATENT DOCUMENTS

AU 2007200592 3/2007
AU 2007200592 A1 3/2007
(Continued)

OTHER PUBLICATIONS

PCT International Preliminary Report on Patentability filed in co-pending PCT Application No. PCT/GB2016/050326 dated Dec. 9, 2016, 9 pages.
(Continued)

*Primary Examiner* — Zakiya W Bates
(74) *Attorney, Agent, or Firm* — Blank Rome, LLP

(57) ABSTRACT

A valve assembly (10) comprises a flow path extending from an assembly inlet (20) to an assembly outlet (22), a valve (24*a*/26*a*) arranged within the flow path and a filter assembly arranged within the flow path between the assembly inlet and the valve. The filter assembly comprises a filter chamber defining a particle settlement region, a filter chamber inlet for facilitating inflow of a fluid into the chamber, and a filter chamber outlet for facilitating outflow of fluid from the chamber towards the valve, wherein the filter chamber outlet includes a particle filter.

22 Claims, 3 Drawing Sheets

(51) Int. Cl.

| | |
|---|---|
| ***E21B 27/00*** | (2006.01) |
| ***E21B 43/16*** | (2006.01) |
| *E21B 41/00* | (2006.01) |

(58) Field of Classification Search
CPC ..... E21B 43/40; E21B 49/10; E21B 43/38; E21B 34/063
See application file for complete search history.

(56) References Cited

U.S. PATENT DOCUMENTS

| | | | | |
|---|---|---|---|---|
| 4,791,991 | A | 12/1988 | Morris et al. | |
| 6,237,693 | B1 | 5/2001 | Deaton | |
| 2006/0021750 | A1 | 2/2006 | Lugtmeier et al. | |
| 2006/0137881 | A1 | 6/2006 | Schmidt et al. | |
| 2009/0050333 | A1 | 2/2009 | Smith et al. | |
| 2011/0168397 | A1 | 7/2011 | Churchill | |
| 2014/0182855 | A1 | 7/2014 | Woodford | |
| 2015/0027726 | A1* | 1/2015 | Bruce ..... | E21B 33/1208 166/373 |

FOREIGN PATENT DOCUMENTS

| | | |
|---|---|---|
| CN | 2589666 | 12/2003 |
| CN | 201196047 | 2/2009 |
| CN | 201386538 | 1/2010 |
| CN | 202767921 | 3/2013 |
| CN | 203547609 | 4/2014 |
| CN | 204041000 | 12/2014 |

OTHER PUBLICATIONS

PCT Search Report and Written Opinion filed in co-pending PCT Application No. PCT/GB2016/050326 dated Apr. 22, 2016, 12 pages.

Great Britain Search Report filed in co-pending GB Application No. GB1502271 dated Sep. 15, 2015, 4 pages.

International Preliminary Report on Patentability received in co-pending PCT Application No. PCT/GB2016/05326, dated Nov. 2, 2016, 16-pgs.

* cited by examiner

VALVE ASSEMBLY WITH A FILTER CHAMBER

FIELD

The present invention relates to a valve assembly such as might be used in injection applications in wellbores.

BACKGROUND

When producing hydrocarbons from a wellbore, it is often advantageous to inject chemicals such as treatment fluids into the production fluid. This may, for example, help to prevent the deposition of sulphur from or change the viscosity of the production fluid.

In wellbores intended for the production of natural gas, a degree of liquid—this may be water or hydrocarbons—is often also produced. In the early stages of production, the reservoir pressure is often sufficient to remove these liquids from the wellbore. As production continues, the reservoir pressure drops and often becomes insufficient to remove liquids from the well which may accumulate in the wellbore and inhibit the production of natural gas. In this case, injection of a foaming agent may assist to reduce the density of liquids which have accumulated in the wellbore. This may facilitate their removal from the wellbore at lower reservoir pressures.

It is known in the art to use capillary injection strings inserted into the wellbores to inject treatment fluids into the wellbore. Such capillary injection strings often have a very small diameter and may include several components, such as valve assemblies. There may be some applications which require low flow rates, and which require a valve in the valve assembly to provide a very small open area. Such a small open area may increase the liability of this type of valve to blocking by unwanted particles in the fluid. The small diameter of the components increases their likelihood of becoming blocked. This may therefore introduce complexities of frequent replacement of components within the capillary string.

SUMMARY

An aspect or embodiment relates to a valve assembly. The valve assembly may have application in numerous flow control uses. In some embodiments the valve assembly may be for use within a wellbore. As such, aspects of the invention may relate to a downhole valve assembly.

The valve assembly may comprise a flow path extending from an assembly inlet to an assembly outlet. A valve may be arranged within the flow path. A filter assembly may be arranged within the flow path between the assembly inlet and the valve. The filter assembly may comprise a filter chamber defining a particle settlement region. The filter assembly may comprise a filter chamber inlet for facilitating inflow of a fluid into the chamber. The filter assembly may comprise a filter chamber outlet for facilitating outflow of fluid from the chamber towards the valve. The filter chamber outlet includes a particle filter.

In use, the filter assembly may function to protect the valve from damage from particles within the fluid. The flow path may guide the fluid from the assembly inlet, through the filter assembly followed by the valve, and through the assembly outlet.

The filter assembly may comprise a dual function of particle removal through both sedimentation of particles (for example by the effect of gravity) and matter within the settlement chamber and filtration by the particle filter to remove a high degree of particles from fluid flow.

The filter assembly may function to reduce the number of particles in the fluid flow downstream of the filter assembly. Reducing the number of particles in the fluid flow may assist to prolong the life of the valve downstream of the filter assembly. A prolonged life of the valve may reduce the frequency with which the valve may need to be replaced and therefore minimise the down time of the valve assembly and any associated system.

Having a dual function of particle removal through both sedimentation and filtration of particles may more effectively prevent particles from remaining in the flow downstream of the filter chamber. This configuration may also assist to increase the total volume of particles that may be filtered before the filtration components become saturated. Each filter type may comprise a mechanism by which it is able to preferentially remove a particular type of particle, for example particles of a particular size, density or shape.

The valve assembly may be suitable for downhole use, for example within a wellbore.

The valve assembly may be coupled to a fluid conduit, for example a fluid conduit which extends into a wellbore. The fluid conduit may be attached to more than one valve assembly, for example two valve assemblies, such as valve assemblies according to an aspect of the present invention. The fluid conduit may be, for example, a capillary line. In some embodiments of the invention, the fluid conduit may be used in wellbores in the oil and gas industry. The fluid conduit may be used to inject a fluid into a wellbore to encourage production through that well bore. Alternatively, the fluid conduit may inject fluid into a wellbore to encourage production from another wellbore, in which case the fluid conduit may be part of an injection only wellbore. The fluid conduit may be used in a wellbore in an industry outside of oil and gas, for example wastewater or chemical disposal or sequestration.

The valve may be or comprise any suitable valve. The valve may comprise a modular component of the valve assembly. The valve may comprise a valve member and a valve seat, wherein the valve member cooperates with the valve seat to control flow along the flow path. The valve seat may be defined by the housing. The valve seat may assist to provide a seal with the valve member when the valve is in a closed position. The valve may be or comprise a one way valve. The valve may be or comprise a crack valve. The valve may be or comprise a two way valve.

The valve may function to restrict the flow of fluid. The valve may function to allow the flow of fluid in only one direction through the valve assembly. The valve may function to allow only the passage of a fluid of a particular density. The functioning of the valve may have the effect of removing, or at least reducing, the risk of fluids, such as production fluids, from entering the valve assembly and/or the fluid conduit. The valve may assist to ensure the safe operation of the fluid conduit. The valve may be or comprise a pressure relief valve.

The valve assembly may comprise or define a conduit for a fluid. The fluid may function to interact with or activate another device or system, such as another device or system within a wellbore. For example, the fluid may function to operate a subsurface safety valve. This interaction may eliminate the need to have an additional actuation fluid conduit connected to the other device.

The valve assembly may comprise multiple valves. The multiple valves may be arranged in series. The valve assembly may be modular.

The valve assembly may comprise a housing. The valve assembly may comprise several components, each with a separate housing. The separate housings may be coupled together. The geometry of the housing may take any appropriate shape. The geometry of the housing may be cylindrical. The housing may comprise a central longitudinal axis. The housing may define or at least partially define a component of the valve assembly, for example the assembly inlet and/or the assembly outlet.

The valve assembly may be modular. That is, the valve assembly may comprise several components which may be able to be fitted together to form the entire valve assembly.

The width or outer diameter of the valve assembly may be constrained by its application. The width of the valve assembly may permit the valve assembly to be fitted inside a wellbore, such as within or as part of a wellbore completion. The relative size of the valve assembly compared to the wellbore may be such that, in one exemplary downhole use, there is a space between the wellbore and the valve assembly. The space may be in the form of an annular or substantially annular space. The space may facilitate well production. The well production may be able to occur at the same time as fluid injection via the valve assembly. The space may also or alternatively facilitate transfer of an injection fluid downhole.

The filter chamber inlet may be defined by a chamber inlet port. The chamber inlet port may be defined by a wall of the filter chamber. The inlet port may function to direct flow into the filter chamber. The position of the inlet port may be constrained by the location of the flow path. A centre of the chamber inlet port may be aligned with a central axis of the valve assembly. Alternatively, the centre of the chamber inlet port may be offset relative to the central axis of the valve assembly.

The filter chamber inlet may be configured to alter aspects of the fluid flow. The chamber inlet may be configured such that the fluid enters the filter chamber with a specific flow characteristic. The filter chamber inlet may be configured to accommodate or establish a laminar flow. Alternatively the filter chamber inlet may be configured to accommodate or establish a turbulent flow. The filter chamber inlet may be configured to generate a swirl component within the fluid to create fluid swirl in the chamber. The chamber inlet may be angled or curved to achieve a desired flow characteristic. The shape of the chamber inlet may be, for example, circular, oval, polygonal, irregular or a combination thereof.

The filter chamber inlet may comprise or be connected to an inlet component. The inlet component may assist to direct the flow of fluid into the filter chamber. The inlet component may comprise a tubular member. The inlet component may assist to direct the flow of fluid from the filter chamber inlet towards a particular inlet section or region of the filter chamber. The inlet component may be chosen to maximise the efficacy of the particle settlement in the particle settlement region. The inlet component may assist to direct the flow of fluid from the filter chamber inlet and away from some regions of the filter chamber, such as the particle filter. Directing the flow in this way may prolong the life of the filter assembly by preventing particles from becoming lodged in the particle filter immediately upon entering the particle filter.

The filter chamber inlet may comprise an inlet filter. The inlet filter may prevent some particles from entering the filter chamber.

The particle settlement region may be a defined region within the filter chamber. The filter chamber may be able to function regardless of how full the particle settlement chamber is. The boundaries of the particle settlement region may be defined by the maximum volume of particles which may settle in the filter chamber without restricting and/or preventing fluid flow. In some embodiments, it may be advantageous to position the filter chamber inlet and outlet to maximise the volume of the particle settlement region.

During use, the flow rate of fluid through the chamber inlet may at times vary from the flow rate of fluid through the chamber outlet. During initial operation of the valve assembly, a flow rate of the fluid through the filter chamber inlet may be greater than a flow rate through the filter chamber outlet. This difference in flow rates may allow the filter chamber to completely or near completely fill with fluid. Once this point has been reached, the flow rate of fluid through the filter chamber inlet and filter chamber outlet may be substantially the same.

An operator may be able to vary a flow rate through the valve assembly. Varying flow rate may assist to remove particles which may be inhibiting the function of the valve assembly. For example, varying the flow rate may cause particles which are lodged in the particle filter to become dislodged. Varying the flow rate may encourage particles to settle in the particle settlement region.

The filter chamber may have a preferred orientation. The orientation may define the particle settlement region at a lower region of the chamber. The filter chamber outlet may be located above the particle settlement region. The filter chamber inlet may be located towards the top of the filter chamber.

The filter chamber may have a preferred orientation, but may also be able to function in alternative orientations. For example, when in the preferred orientation the particle settlement region may be at a lower region of the filter chamber. The particle settlement region may also be able to be located on the side or at the top of the filter chamber, should the orientation of the filter chamber change. In an alternative orientation, the functionality of the filter chamber may be maintained. The positioning of the filter chamber inlet and filter chamber outlet may assist to avoid blocking with particles from the particle settlement region. For example, it may be beneficial to locate the filter chamber inlet and filter chamber outlet separate from any regions which may form part of the particle settlement region in alternative orientations.

The filter chamber may have no preferred orientation. The filter chamber may be able to function in any orientation. The filter chamber inlet and/or filter chamber outlet may be located towards a centre of the filter chamber to facilitate function of the filter chamber in any orientation. Such positioning may assist to locate the filter chamber inlet and/or filter chamber outlet as far above the particle settlement region as possible, regardless of the orientation of the filter chamber. To achieve this positioning, the filter chamber inlet and/or outlet may be located on a structure, for example a length of tubing.

The filter chamber may comprise more than one method of excluding particles from sections of fluid flow, for example two methods of excluding particles from sections of fluid flow. The particle settlement region may define one method of exclusion and the particle filter may define another method of exclusion. The two methods of exclusion may assist to provide the particle filter with the dual function of particle exclusion.

The filter chamber may be configured such that a residence time within the filter chamber of the fluid is sufficient to allow particles to settle out of the fluid flow, for example by the effect of gravity. The filter chamber may cause particles that are more dense than the fluid to settle out of the fluid flow. The filter chamber may slow down the flow of the fluid to allow the particles more time to settle out of the flow.

The particle settlement region may be of sufficient size to increase the residence time of the fluid. The particle settlement region may comprise a geometric feature or structure to increase the fluid residence time in the particle settlement region.

The particle settlement region may be configured to discourage particles which have settled in the particle settlement region from re-entering the flow. For example, the particle settlement region may be located separate or removed from the flow path. The particle settlement region may contain a geometric feature or structure to trap settled particles, or minimise disturbances from incoming flow.

The filter chamber outlet may be defined by a chamber outlet port. The chamber outlet port may be defined by a wall of the filter chamber. The positioning of the filter chamber outlet may assist to maximise the volume of the particle settlement region in a particular orientation.

The filter chamber outlet may be defined by an outlet component within the filter chamber. The outlet component may comprise a tubular member. The outlet component may allow the chamber outlet to be in a location other than a wall of the filter chamber. The outlet component may extend from the wall of the filter chamber and towards an internal section of the filter chamber. The outlet component may extend from the wall of the filter chamber and towards the centre of the filter chamber. The outlet component may extend through the particle settlement region. The outlet component may allow the chamber outlet to be positioned towards the centre of the filter chamber. In this configuration, the positioning of the filter chamber outlet may assist to maximise the volume of the particle settlement region in more than one orientation.

The filter chamber outlet may assist to prevent particles which have not settled in the particle settlement region from leaving the filter chamber. The particle filter may comprise a mesh structure. The particle filter may also or alternatively comprise an array of apertures. A sintered material may be used to form the particle filter. The structure of the sintered material may enable filtration of the fluid. The filter chamber outlet may comprise an integrated particle filter. The filter chamber outlet may alternatively or also comprise a particle filter which may be fitted onto the filter chamber outlet. The filter chamber outlet may comprise a particle filter which may be able to be removed and replaced.

The particle filter may comprise more than one layer of filtration material. The particle filter may exclude particles from sections of the flow on a size exclusion basis. The size exclusion of particles may mean that particles which are over a specific size may be excluded from progressing further in the fluid flow.

The particle settlement region and particle filter may be positioned such that both the volume of the particle settlement region and the area of the particle filter are maximised. The effective lifespan of the valve assembly may be dependent on particles being contained within the particle settlement region, and not blocking the particle filter. In some embodiments, this positioning may provide the advantage that the effective lifespan of the valve assembly is maximised.

The assembly outlet may allow the outflow of fluid from the device. The assembly outlet may be configured to attach to an external device. Alternatively, the assembly outlet may be configured to allow fluid flow into the wellbore.

The assembly outlet may comprise a component to agitate the fluid. Agitation may cause a change in the properties of the fluid, for example, agitation may cause the fluid to become aerated or to change in state or volume.

In operation, for example in a wellbore, the valve assembly may be connected or connectable to a fluid conduit. The fluid conduit may comprise connections to more than one valve assembly, for example two valve assemblies. Each valve assembly may be modular and may comprise different components. The valve assemblies may be generally similar. The valve assemblies may comprise multiple of one or several of the constituent components of the valve assembly. In some embodiments there may exist, for example, more than one valve in a single valve assembly. Multiple valves may improve a certain quality of the valve assembly, for example safety or reliability. Some embodiments of the valve assembly may comprise an outlet component. The outlet component may be in place of a connector to a further section of the fluid conduit. The outlet component of the valve assembly may permit the valve assembly to have different uses. For example, to allow the valve assembly to connect to an additional conduit and/or to allow the valve assembly to inject a fluid into a cavity.

In one exemplary downhole use, the valve assembly may accommodate the flow of a fluid which may be generally regarded as a well injection fluid. The fluid may also or alternatively be generally regarded as a well treatment fluid. The fluid may be configured to mix with a fluid in a well or subsurface reservoir. The fluid may also or alternatively be configured to remain separate from a fluid in the well or subsurface reservoir. The fluid may be designed to float on and/or sink through a fluid in the well or subsurface reservoir. The fluid may be designed to change state at least once when in use, for example from a gas to a solid or from a liquid to a foam. The fluid may be, for example, a production enhancement fluid such as a foaming agent.

The fluid may be for use in an injection only well. The purpose of the fluid may be to displace some or all of the contents of the subsurface reservoir. The purpose of the fluid may be to block or seal fluids into the subsurface reservoir. The purpose of the fluid may also be to change a property of a fluid in well and/or subsurface reservoir, for example viscosity, density or composition.

The fluid may have a secondary function within the wellbore. The fluid may be in communication with a secondary device in the wellbore, for example a Subsurface Safety Valve (SSSV). The fluid may be transported to the appropriate section of the wellbore via a fluid conduit. The fluid conduit may be located externally to the casing of the wellbore. The fluid conduit may connect to the assembly inlet of the valve assembly. The fluid conduit may also connect to a secondary device. The fluid may function to actuate the external device. The fluid conduit may direct the fluid into an actuation chamber. The external device may be, for example, a valve such as a SSSV. The purpose of the SSSV may be to restrict or prevent the flow of production fluids within the wellbore.

An aspect or embodiment relates to a method for flow control, comprising:

- flowing a fluid through a valve assembly inlet and into a filter chamber;
- permitting particles to settle from the fluid into a particle settlement region of the filter chamber;
- flowing the fluid through a chamber outlet which includes a particle filter;
- flowing the fluid through a valve arrangement; and
- flowing the fluid towards a valve assembly outlet.

The method may be implemented by any valve assembly according to any other aspect.

An aspect or embodiment relates to a wellbore injection system, comprising:

- a fluid injection conduit for injecting a fluid within a wellbore; and
- a valve assembly coupled to the fluid injection conduit and configured to control injection fluid flow along the fluid injection conduit, wherein the valve assembly comprises:
  - a valve;
  - a filter chamber located upstream of the valve and defining a particle settlement region;
  - a filter chamber inlet for facilitating inflow of a fluid into the chamber; and
  - a filter chamber outlet for facilitating outflow of fluid from the chamber towards the valve, wherein the filter chamber outlet includes a particle filter.

The wellbore injection system may comprise a valve assembly according to any other aspect.

The wellbore injection system may comprise a supply conduit, configured to supply injection fluid to the fluid injection conduit. The supply conduit may extend to surface.

The wellbore injection system may comprise a fluid splitter assembly, configured to split or divert at least a portion of injection to fluid towards a separate device or system within the wellbore, such as a subsurface safety valve.

An aspect or embodiment relates to a filter assembly for use within a flow path, comprising:

- a filter chamber defining a particle settlement region;
- a filter chamber inlet for facilitating inflow of a fluid into the chamber;
- a filter chamber outlet for facilitating outflow of fluid from the chamber, wherein the filter chamber outlet includes a particle filter.

The features defined in relation to one aspect may be provided in combination with any other aspect.

BRIEF DESCRIPTION OF DRAWINGS

These and other aspects will now be described, by way of example only, with reference to the accompanying drawings, in which.

DETAILED DESCRIPTION OF DRAWINGS

Figure 1:
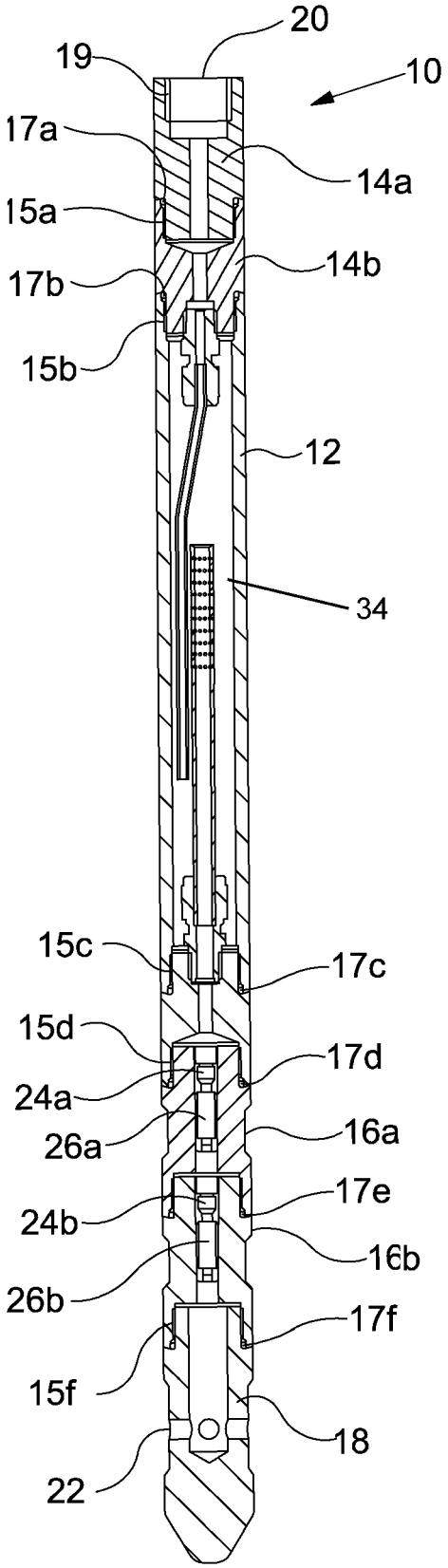
FIG. 1 is a sectional view through a longitudinal plane of a valve assembly in accordance with an embodiment of the present invention.

FIG. 1 is a sectional view through a longitudinal plane of a valve assembly, generally identified by reference numeral 10, in accordance with an embodiment of the present invention. The valve assembly 10 is illustrated in FIG. 1 as a standalone component, although in some embodiments the valve assembly 10 may be attached to or integrated with an external device.

The valve assembly 10 is modular, consisting of a filter assembly 12, assembly inlet components 14*a*, 14*b*, valve components 16*a*, 16*b* and an assembly outlet component 18. Each of the components comprises a connector, which may be a standard connector between all of the components, which enables the components to fit together to form the entire valve assembly 10. In the illustrated embodiment the connectors each comprise a threaded section 15*a-f* to facilitate their connection, and a sealing component 17*a-f* is also present to prevent the leakage of fluid from the valve assembly 10 to the external environment. Inlet component 14*a* further comprises an assembly inlet 20 with a threaded section 19 to facilitate the connection of the valve assembly 10 to an external device (not shown).

Each of the components of the valve assembly 10 has a circular or substantially circular lateral cross section and is generally cylindrical in shape. In alternative embodiments of the invention, the lateral cross section may be any appropriate shape. For example, the lateral cross section may take an oval, polygonal or irregular form.

The valve assembly 10 shown is configured to allow an inflow of fluid (not shown) through assembly inlet 20 and an outflow through an assembly outlet 22.

Valves 16*a*, 16*b* each comprise a valve member 24*a*, 24*b* and a valve seat 26*a*, 26*b*. As illustrated in FIG. 1, the valves 16*a*, 16*b* are crack valves, which function to open to permit flow in a forward direction (from inlet 20 to outlet 22) upon expose to a predetermined pressure differential. The function of valves 16*a*, 16*b* may be to permit only unidirectional flow of fluid and/or to avoid reverse flow from the outlet 22 to the inlet. In alternative embodiments of the invention, the valves 16*a*, 16*b* may be any appropriate valve type. For example, the valves 16*a*, 16*b* may be two-way valves. This may assist in circumstances where reverse flow through the valve assembly 10 is desirable, for example to clear sediment from the valve assembly 10.

As noted above, the valves 16*a*, 16*b* may have a pressure relief function. For example, valves 16*a*, 16*b* may only open once a pressure value or pressure differential is exceeded. Alternatively, valves 16*a*, 16*b* may only open when there is experienced a particular change in pressure of the fluid. The valves 16*a*, 16*b* may open when flow is in one direction, but may prevent flow in the other direction.

Figure 2:
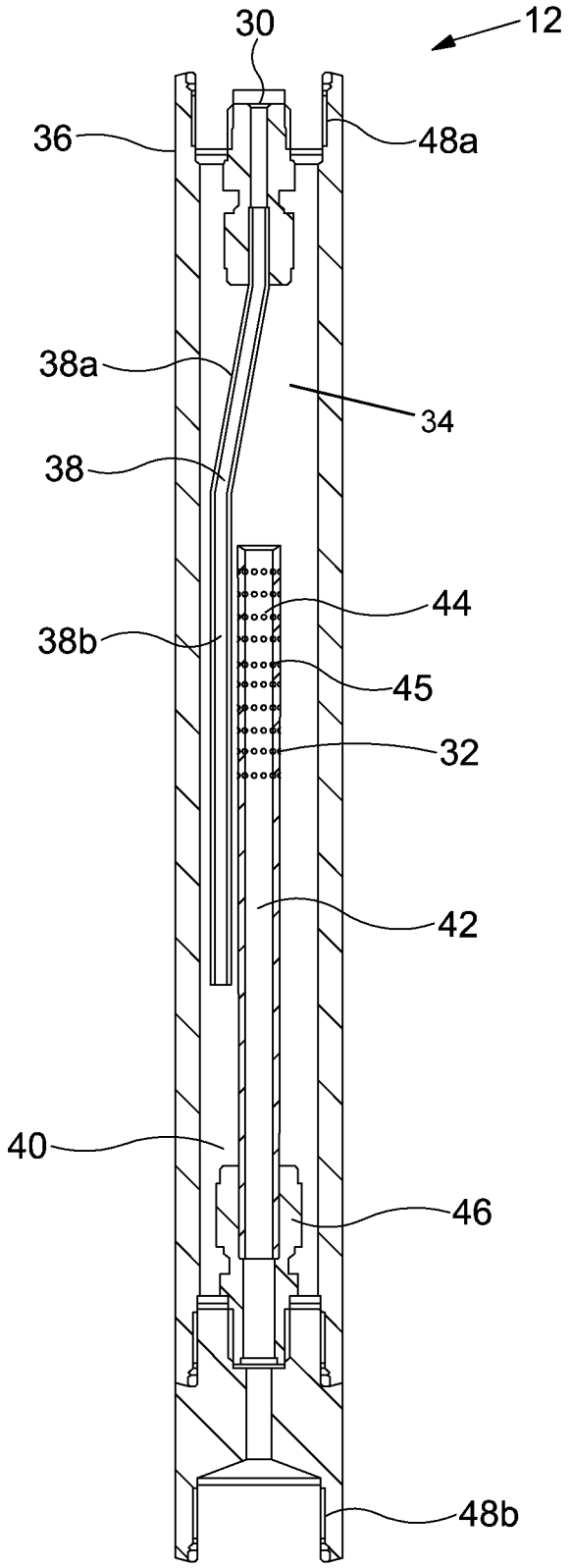
FIG. 2 is an enlarged view of a filter assembly of the valve assembly in FIG. 1.

FIG. 2 is an enlarged view of the filter assembly 12 of the valve assembly 10 in FIG. 1. In the illustrated embodiment, the filter assembly includes a filter chamber 34 which is substantially cylindrical in form, and generally comprises a chamber inlet port 30 and a chamber outlet 32. An inlet tube 38 is coupled to the chamber inlet port 30 such that fluid entering into the filter chamber 34 flows through inlet tube 38. Inlet tube 38 is configured to deliver the fluid to a specific region of the filter chamber 34. Inlet tubing 38 deviates the fluid flow from being aligned with the central axis of the valve assembly 10 from being offset from the central axis. Fluid enters filter chamber 34 of the filter assembly 12 via a chamber inlet port 30 and exits via a chamber outlet port 32. The chamber inlet port 30 is defined by the filter chamber housing 36 and is positioned at the top of the filter chamber 34. The chamber inlet port 30 is aligned with the central axis of the filter assembly 12.

Inlet tube 38 extends longitudinally from chamber inlet port 30. The inlet tube 38 comprises a first section 38*a* which extends at an acute angle relative to the top of the filter chamber 34. The inlet tube 38 comprises a section which extends from first section 38*a* parallel to the wall of the filter chamber 34. In this configuration, the inlet tube 38 assists to direct the flow of fluid into a specific section of the filter chamber 34.

A particle settlement region 40 is defined in a lower region of the filter chamber 34. In the illustrated orientation of the filter assembly 12, the particle settlement region 40 is located at the base of the filter chamber 34. The particle settlement region 40 may be designed to hold particles which have settled out of the fluid flow, for example by the effect of gravity.

Supported by the housing 36 at the base of the filter chamber 34 is an outlet tube 42. The outlet tube 42 longitudinally extends from the base of the filter chamber 34 to the approximate centre of the filter chamber 34. Outlet tube 42 is shown extending through particle settlement region 40, although in alternative orientations outlet tube 42 may be located at different sections of the filter chamber 34. Outlet tube 42 is secured to the housing 36 via an outlet tube connector 46. Outlet tube connector 46 assists to position the outlet tube 42 such that outlet tube 42 directs the fluid flow towards a downstream component in the valve assembly 10, for example a valve member 24*a*, 24*b* or assembly outlet component 18 (FIG. 1).

The outlet tube connector 46 is screwed into the housing 36. A threaded portion on both the outlet tube connector 46 and the housing 36 facilitates the screw connection. The outlet tube connector 46 may connect to the housing 36 via any other appropriate method, for example chemical bonding or welding.

The outlet tube 42 comprises a particle filter 44 towards the upper end. The particle filter 44 may be directly formed in the tube, as in FIG. 2, or may take the form of a separate component which is attached to the tube.

As the filter assembly 12 is used, the particle settlement region 40 may begin to fill with particles which settle from the fluid flow. Positioning the filter 44 away from the base of the filter chamber 34 may allow for an increased volume of the particle settlement region 40. An increased volume of the particle settlement region 40 may maximise the effective life span of the filter assembly 12 before blocking or choking occurs.

In the illustrated orientation of FIG. 2, the outlet of the inlet tube 38 is located below the chamber outlet port 32. This configuration may assist to prevent particles which may be present in the fluid flow from cascading over the chamber outlet port 32 upon entry to the filter chamber 34, thereby avoiding or minimising the risk of premature blocking or choking of the chamber outlet port 32.

The particle filter 44 as illustrated in FIG. 2 comprises an array of apertures 45. The maximum width of these apertures defines the maximum width of particles which may pass through. The array of apertures therefore functions as a particle filter. Although not shown, the particle filter 44 may also or alternatively comprise a mesh structure.

Alternatively, the mesh structure may be located internal or external to the outlet tube 42, to provide a secondary degree of particle filtration. The particle filter 44 may comprise as many layers as is necessary to provide the required degree of particle filtration.

The outlet tube 42 directs the fluid flow from the chamber outlet port 32 towards the valves 16*a*, 16*b* (FIG. 1).

As illustrated in FIG. 2, the filter assembly 12 is one modular component of the valve assembly 10. Threaded portions 48*a*, 48*b* facilitate a connection to other portions of the valve assembly 10. The connection may be achieved using any other appropriate method, for example chemical bonding or the like.

Figure 3:
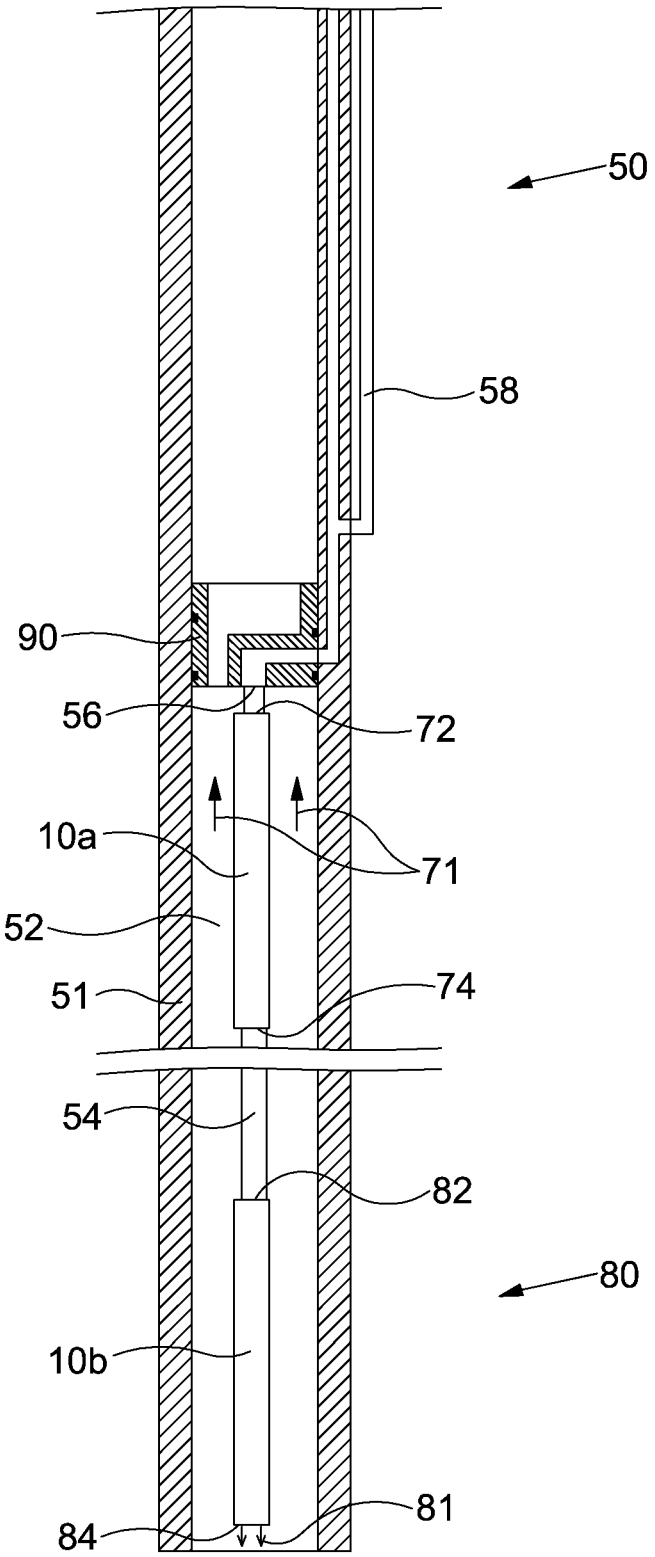
FIG. 3 is a diagrammatic illustration of a wellbore system containing a valve assembly according to an embodiment of the present invention.

FIG. 3 illustrates an example of a wellbore completion system 50 according to an embodiment of the present invention. The wellbore completion system 50 comprises a wellbore injection system 80 and a Subsurface Safety Valve (SSSV) 70.

Wellbore injection system 80 comprises upper and lower valve assemblies 10*a*, 10*b*, which are each similar to valve assembly 10 described above. Upper and lower valve assemblies 10*a*, 10*b* are connected to wellbore conduit 54. Upper valve assembly 10*a* comprises both an inlet conduit connection 72—permitting injection fluid to flow into valve assembly 10*a* from wellbore conduit 54—and an outlet conduit connection 74—permitting injection fluid to flow from valve assembly 10*a* into wellbore conduit 54. Valve assembly 10*b* comprises an inlet conduit connection 82—permitting injection fluid to flow into valve assembly 10*b* from wellbore conduit 54—and a conduit outlet module 84—permitting fluid to flow through a nozzle into a wellbore 51. Injection fluid may flow from the conduit outlet module 84 in the direction of arrows 81. The conduit outlet module 84 may comprise a geometric feature to direct or agitate the fluid flowing into wellbore completion system 50.

Upper and lower valve assemblies 10*a*, 10*b* may be generally similar. Both upper and lower valve assemblies 10*a*, 10*b* may be modular. Upper and lower valve assemblies 10*a*, 10*b* may comprise one or several of the same components. Upper valve assembly 10*a* may comprise, for example, one valve (not shown). Lower valve assembly 10*b* may comprise, for example two valves (not shown). Additional valves may be positioned in series to one another.

An annulus space 52 exists between the wellbore injection system 80 and the wellbore pipe 51. Fluid, for example production fluids, may flow through annulus space 52 in the direction of arrows 71.

Wellbore injection system 80 is connected to a flow divider 90 which facilitates a fluid connection between wellbore injection system 80 and an injection supply conduit 58. Injection supply conduit 58 provides injection fluid both to the SSSV 70 and the wellbore injection system 80 and may extend to the surface of the well. Flow divider 90 also permits the flow of fluids, for example production fluids, to flow between regions further into wellbore injection system 80 and the SSSV 70.

SSSV 70 comprises a flapper valve 62 which may restrict the flow of production fluids, and a flow tube 61 which is configured to facilitate opening of the flapper valve 62. Flow tube 61 is contained within through bore section and comprises an annular seal section 65. A spring member 63 provides a biasing force on the annular seal section 65 which acts to move flow tube 61 into a position in which the flapper valve 62 is closed, as illustrated in FIG. 3. An actuation chamber 60 is connected to injection supply conduit 58. The injection supply conduit 58 may divert at least a part of the flow or at least communicate injection fluid pressure to the SSSV 70, and in particular into the actuation chamber 60. When the force acting on the annular seal section 65 due to the pressure in actuation chamber 60 exceeds the biasing force applied by the spring member 63, the flow tube 61 may move axially to force flapper valve 62 into an open configuration. When the force applied by spring member 63 is greater than that applied due to pressure in the actuation chamber 60, the flow tube 61 may move to allow flapper valve 62 to move towards a closed position. In the event of a loss of pressure of injection fluid, the pressure in actuation chamber 60 will similarly be lost and spring member 63 will act to close the flapper valve. This effect may act as a safety feature of the wellbore completion system 50. In this configuration, the injection supply conduit 58 may have dual functionality of providing both injection fluid for the wellbore injection system 80 and injection fluid—which may act as an actuation fluid—to the SSSV 70.

It should be understood that the embodiments described herein are merely exemplary and that various modifications may be made thereto without departing from the scope of the present invention.

The invention claimed is:

1. A downhole valve assembly for location within a wellbore, comprising:

a flow path extending from an assembly inlet to an assembly outlet;

a valve arranged within the flow path; and a filter assembly arranged within the flow path on one axial side of the valve and between the assembly inlet and the valve, the filter assembly comprising:

a filter chamber defining a particle settlement region located at a base of the filter chamber;

a filter chamber inlet located at a top of the filter chamber for facilitating inflow of a fluid into the filter chamber;

an inlet tube coupled to the filter chamber inlet and configured to deviate the fluid flow from being aligned with a central axis of the downhole valve assembly; and an outlet tube defining part of the flow path and extending partially into the filter chamber from the base of the filter chamber and through the particle settlement region, the outlet tube including a filter chamber outlet in a wall thereof such that the filter chamber outlet is located within the filter chamber intermediate the base and the top of said filter chamber for facilitating outflow of fluid from the filter chamber towards the valve, wherein the filter chamber outlet includes a particle filter.

2. The downhole valve assembly according to claim 1, wherein the valve assembly is modular and comprises a valve module and a filter assembly module connected to one axial end of the valve module, the valve module and the filter assembly module defining a portion of the flow path.

3. The downhole valve assembly according to claim 1, wherein the filter chamber inlet is configured to alter aspects of the fluid flow.

4. The downhole valve assembly according to claim 1, wherein the inlet tube directs the flow of fluid.

5. The downhole valve assembly according to claim 1, wherein the outlet tube extends through the particle settlement region.

6. The downhole valve assembly according to claim 1, wherein the particle filter of the filter chamber outlet assists to prevent particles which have not settled in the particle settlement region from leaving the filter chamber via the outlet tube.

7. The downhole valve assembly according to claim 1, wherein the filter chamber outlet comprises an integrated particle filter, directly formed in the outlet tube.

8. The downhole valve assembly according to claim 1, wherein the filter chamber outlet comprises a particle filter which is fitted to the filter chamber outlet.

9. The downhole valve assembly according to claim 1, wherein the filter chamber outlet comprises a particle filter which can be removed and replaced.

10. The downhole valve assembly according to claim 1, wherein the particle filter comprises one or more layers of a filtration material.

11. The downhole valve assembly according to claim 1, wherein the valve comprises a one way valve.

12. The downhole valve assembly according to claim 1, wherein the valve comprises a two way valve.

13. The downhole valve assembly according to claim 1, wherein the assembly outlet comprises a component to agitate the fluid.

14. The downhole valve assembly according to claim 1, wherein the fluid comprises a well injection fluid.

15. The downhole valve assembly according to claim 1, wherein the fluid is designed to change state at least once when in use.

16. The downhole valve assembly according to claim 1, wherein the fluid is in communication with a wellbore.

17. The downhole valve assembly according to claim 1, wherein the fluid is in communication with a secondary device.

18. The downhole valve assembly according to claim 17, wherein the secondary device comprises a subsurface safety valve.

19. The downhole valve assembly according to claim 1, operable in inverted orientations.

20. The downhole valve assembly according to claim 1, wherein the assembly outlet is connectable to a wellbore conduit.

21. A wellbore injection system, comprising:

a fluid injection conduit for injecting a fluid within a wellbore; and a downhole valve assembly according to claim 1 coupled to the fluid injection conduit.

22. A method for flow control in a wellbore, comprising locating a downhole valve assembly according to claim 1 in a wellbore and flowing a fluid through the downhole valve assembly.

* * * * *